US009560941B2

(12) United States Patent
Seifried

(10) Patent No.: US 9,560,941 B2
(45) Date of Patent: Feb. 7, 2017

(54) WIPING BOARD APPARATUS

(71) Applicant: James R. Seifried, Fort Myers, FL (US)

(72) Inventor: James R. Seifried, Fort Myers, FL (US)

( * ) Notice: Subject to any disclaimer, the term of this patent is extended or adjusted under 35 U.S.C. 154(b) by 0 days.

(21) Appl. No.: 14/970,810

(22) Filed: Dec. 16, 2015

(65) Prior Publication Data

US 2016/0174776 A1 Jun. 23, 2016

Related U.S. Application Data

(60) Provisional application No. 62/092,300, filed on Dec. 16, 2014.

(51) Int. Cl.

| | |
|---|---|
| ***A47K 7/08*** | (2006.01) |
| ***B08B 1/00*** | (2006.01) |
| *A47K 17/00* | (2006.01) |

(52) U.S. Cl.

CPC ..... *A47K 7/08* (2013.01); *B08B 1/006* (2013.01); *A47K 2017/006* (2013.01)

(58) Field of Classification Search

CPC ..... A47K 7/00; A47K 7/08; A47K 10/18; A47K 13/24; A47K 2017/006; B08B 1/006; A61F 2013/15048; A61F 13/36; A61F 13/38

USPC ..... 4/661; 15/210.1, 216, 231; 604/385.14, 604/402, 358

See application file for complete search history.

(56) References Cited

U.S. PATENT DOCUMENTS

| | | | | | |
|---|---|---|---|---|---|
| 365,356 | A * | 6/1887 | Travis | A47L 13/16 | 15/209.1 |
| 4,321,920 | A * | 3/1982 | Gillig | A61M 3/0279 | 604/275 |
| 4,349,288 | A * | 9/1982 | Bond | A47K 7/08 | 401/26 |
| 5,044,040 | A * | 9/1991 | Tetrault | A47K 7/08 | 15/210.1 |
| 5,057,096 | A * | 10/1991 | Faglione | A61F 13/47227 | 604/358 |
| 5,067,194 | A * | 11/1991 | Rosenfeld | A47K 7/08 | 15/144.2 |
| 6,146,365 | A * | 11/2000 | Nguyen | B65D 33/002 | 206/390 |
| 7,698,773 | B2 * | 4/2010 | Sotelo | A47K 7/08 | 15/144.1 |
| 7,707,661 | B2 * | 5/2010 | Issachar | A47K 13/22 | 4/245.1 |
| 8,122,558 | B1 * | 2/2012 | Gary | A47K 7/08 | 134/6 |
| 8,156,598 | B2 * | 4/2012 | McDowell | A47K 7/08 | 15/104.94 |
| 8,341,796 | B1 * | 1/2013 | Rhee | A47K 7/08 | 15/210.1 |
| 8,925,137 | B1 * | 1/2015 | Munoz | A47K 7/08 | 15/143.1 |

(Continued)

*Primary Examiner* — Erin Deery
(74) *Attorney, Agent, or Firm* — William E. Noonan

(57) ABSTRACT

A wiping board apparatus for cleaning the rectal area of a person following defecation includes a generally planar base that is mountable on a toilet seat. The base is adapted for holding an elongate rail that extends longitudinally in a generally front to back orientation relative to the underlying toilet seat. One or more wiping sheets may be attached to at least one of the base and the rail element for covering the rail element. Following defecation, a user sits on the base and slides over the rail to wipe and clean fecal material from the rectal area.

16 Claims, 6 Drawing Sheets

(56) References Cited

U.S. PATENT DOCUMENTS

2005/0005385 A1* 1/2005 Smith ..... A47K 7/028
15/231

* cited by examiner

WIPING BOARD APPARATUS

RELATED APPLICATION

This application claims the benefit of Provisional Application Ser. No. 62/092,300 filed Dec. 16, 2014.

FIELD OF THE INVENTION

This invention relates to a wiping board apparatus for managing personal hygiene and, more particularly, to an apparatus that facilitates cleaning of a person's rectal area after defecation.

BACKGROUND OF THE INVENTION

For over 150 years, traditional hand wiping with toilet paper has been by far the most common technique for cleaning a person's rectal area following defecation. This practice presents many shortcomings. It can be both aesthetically unpleasant and unsanitary. Germs and resulting illnesses can be spread, particularly if the person performing the hand wiping does not immediately and properly wash their hands. Conventional toilet paper wiping also has adverse environmental and economic impacts. Typically, the user employs far more sheets of toilet paper than are actually needed for wiping. Multiple ply toilet paper only adds to this waste. Studies have reported that an average of 57 sheets of paper per person are used and discarded daily. Not only is this quite costly for the individual consumer, it also consumes approximately 27,000 trees per day. Flushed toilet paper must also be processed by municipal and private sewerage and septic systems designed to handle the used and discarded toilet paper.

Hand wiping can also be especially problematic for the elderly, infirmed, young children and other persons with disabilities such as autism and other physical limitations such as rheumatoid arthritis and obesity. Such persons may find it difficult, painful or even impossible to perform the physical movements such as turning, bending, reaching and wiping involved in normal hand wiping.

I have determined that a significant need exists for an apparatus and technique that will allow virtually all persons, including, but not necessarily limited to those described above, to perform post-defecation wiping of the rectal area in a hygienic, environmentally friendly and economically efficient manner superior to conventional hand wiping.

I have also determined that obese persons have a particularly difficult time with defecation and cleaning following defecation due to the relatively wide opening (typically 8-9 inches) formed through most toilet seats. Ideally, the weight of a person seated on the toilet should be borne by the ischial tuberosities bones located at the lower end of the skeletal torso and on respective sides of the anus. These bones are located about 4" apart. However, the opening formed in the typical oval toilet seat, causes the user's weight to be supported largely by the femur bones of the user's legs, which are usually about 10" apart. When an obese person having a considerable amount of fatty tissue sits upon the toilet seat, the fatty tissue surrounding the rectum is compressed to restrict the rectal passageway. As a result, an increased amount of excrement contacts the skin and more tedious, time consuming and unpleasant cleaning effort is required. A solution to this problem is needed.

SUMMARY OF THE INVENTION

It is therefore an object of the present invention to provide a wiping board apparatus that enables the rectal area of the human body to be effectively and quickly cleaned following defecation in a virtually hands free manner.

It is a further object of this invention to provide a wiping board that allows persons with physical limitations, including the elderly, small children and persons with physical infirmities, disabilities and limitations, to effectively clean their rectal area following defecation without having to twist, bend and reach in a manner that may be difficult, uncomfortable or even physically impossible.

It is a further object of this invention to provide a wiping board that replaces conventional hand wiping so that cleaning the rectal area following defecation is performed in a more hygienic and sanitary manner and the risk of spreading germs and illnesses is reduced.

It is a further object of this invention to provide a wiping board that significantly reduces the current use of toilet paper, as well as the hygienic, environmental and economic disadvantages associated with conventional toilet paper wiping.

It is a further object of this invention to provide a wiping board that substantially reduces the consumption and waste of natural resources, including trees and water, as well as the costs related to the use of toilet paper.

It is a further object of this invention to provide a wiping board apparatus that helps to reduce the strain and economic impact upon existing municipal and private septic and sewer systems, which are traditionally required to process used and flushed toilet paper.

It is a further object of this invention to provide a wiping board apparatus that is easy to install on virtually any toilet and which is quick and convenient for virtually any person to use to clean the rectal area following defecation.

It is a further object of this invention to provide a wiping board apparatus employing a toilet seat adapter that significantly reduces the effective opening formed through the toilet seat so that defecation and cleaning following defecation are greatly facilitated, particularly for overweight or obese persons.

It is a further object of this invention to provide a toilet wiping board apparatus featuring a toilet seat adapter that effectively transfers the user's weight from the femur bones to the ischial tuberosities so that less of the user's fatty tissue is compressed and defecation as well as cleaning following defecation are facilitated, particularly for overweight or obese persons.

This invention relates to a wiping board apparatus used in combination with a toilet seat or other seat surface for cleaning a person's rectal area following defecation. The apparatus includes a base for mounting on the toilet seat. The base is adapted for carrying an elongate rail element that extends longitudinally along the base in a generally front to back orientation relative to the toilet seat. The rail element protrudes laterally upwardly from a top surface of the base. At least one flexible wiping sheet is releasably secured to at least one of the base and the rail element such that the wiping sheet covers the rail element protruding from the base. After a person has defecated using the toilet, the base is mounted on the toilet with the rail element facing upwardly and extending generally front to back above the toilet seat. The rail element is covered by the wiping sheet, which is connected to at least one of the base and the rail element. The person who has defecated then sits upon the base and straddles the sheet covered rail element. That person slides forwardly along the rail element such that the wiping sheet wipes and cleans the rectal area of the user. The wiping sheet may then be detached for discard or cleaning. A fresh sheet may be reattached to the base and/or rail element and the wiping procedure may be repeated as needed.

In a preferred embodiment, the wiping board apparatus may include a kit having a plurality of interchangeable rail elements with different respective lateral heights for accommodating different sized persons. The lateral heights of the respective rail elements may vary within the scope of this invention, although it has been determined that 1¼-2½ inch heights are likely the most effective for most persons. The rail elements may be composed of various materials including wood and synthetics. Medically approved plastics may be used. The rail may have varying lengths, although it is preferred that it somewhat shorter than the front to back length of the base.

The base may include a generally flat board or panel composed of a synthetic plastic material, such as polypropylene, which is both hygienic and washable. Various other medical grade plastics may be employed. The base may have various sizes and configurations for fitting and mounting securely upon most, if not all, toilet seats. A rectangular panel configuration is particularly preferred, although other sizes and shapes may be employed within the scope of this invention. The base should be relatively rigid and durable so that it securely supports the weight of virtually any user. Typically the base panel is approximately ⅜" thick.

The base may carry one or more positioning elements that extend upwardly from an upper surface of the base. Each positioning element engages a corresponding hole in a selected rail element to properly position the selected rail element on the base. One or more elastic retaining bands may be wrapped about the base and the selected rail element positioned on the base to secure the rail element in place for use.

Means may be attached to the bottom surface of the base for limiting movement of the base upon the toilet seat. Such means may include one or more non-skid stabilizing components attached to the bottom surface of the base. Each stabilizing component may include a section of a respective retaining band that extends across a bottom surface of the base.

The wiping sheet may include a piece of a flexible cloth-like material such as microfiber, and/or a strip or layers of toilet paper. Preferably one or more strips of toilet paper are attached above one or more layers of the underlying cloth-like material. The wiping sheet(s) may be attached to the rail element by a removable pin, clip, clamp or other means of releasable attachment.

In an alternative preferred embodiment, the wiping board apparatus may further include a toilet seat adapter piece for mounting on the toilet seat or bowl and disengagably supporting the base thereon. The toilet seat adapter piece may be supported on the existing toilet seat or hingedly attached to the toilet bowl for replacing the existing toilet seat. The adapter piece features a board having an elongate defecation slot alignable with either the opening through the toilet seat or the toilet bowl directly. The slot is exposed when the base is disengaged from the adapter piece to allow a user to sit on the adapter piece mounted to the toilet and defecate through the slot. The base may carry a positioning guide assembly that is receivable through the slot for restricting movement between the base and the adapter piece when the base is engaged with the adapter piece and during use of the wiping board apparatus to clean the user's rectal area. The positioning guide assembly may include a pair of guide blocks that respectively abut forward and rearward ends of the defecation slot when the base is engaged with the adapter piece. The adapter piece may carry at least one elastic band or other non-skid component for interengaging the toilet seat or bowl to which the adapter piece is mounted.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
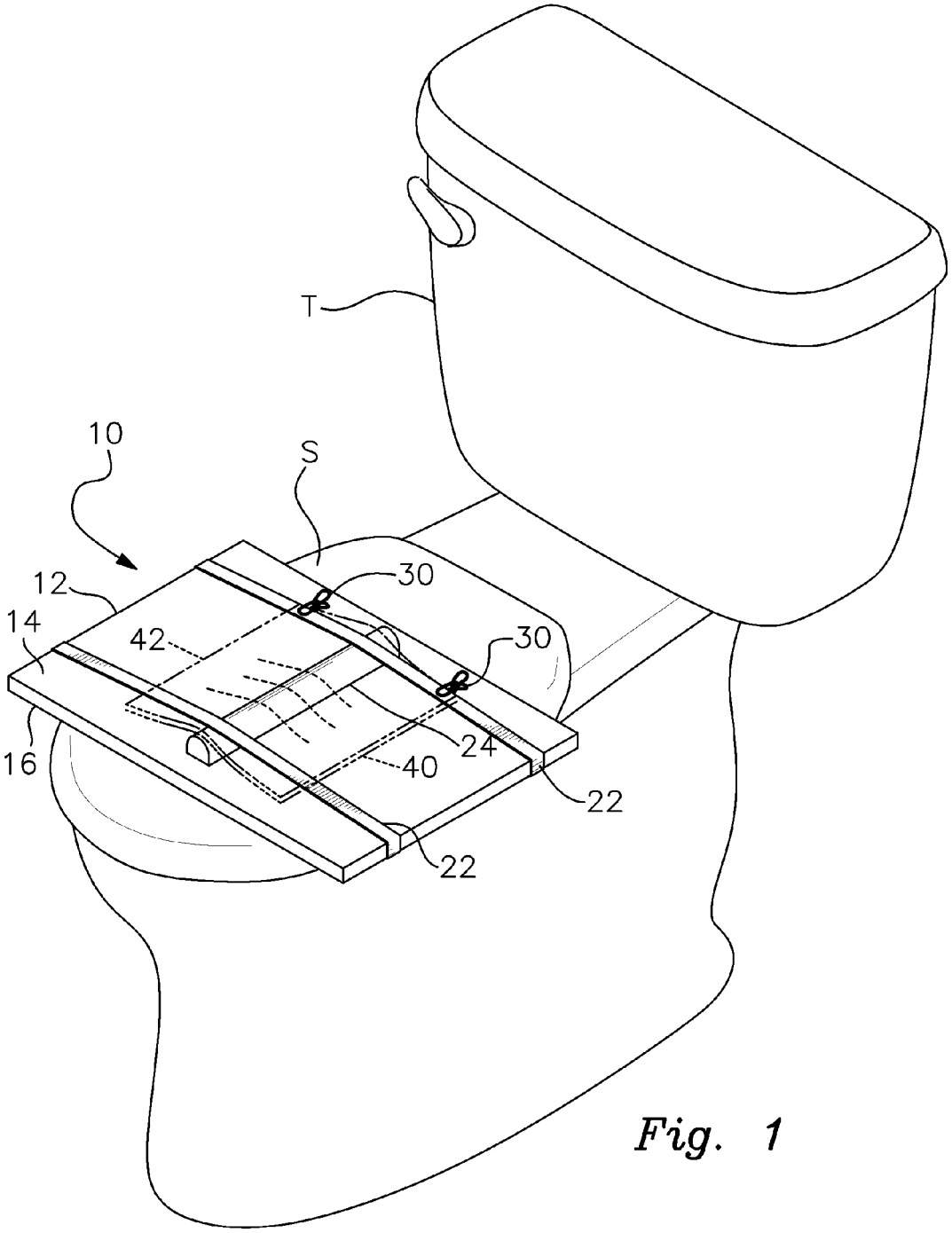
FIG. 1 is a perspective view of one preferred version of the wiping board apparatus of this invention.
Figure 2:
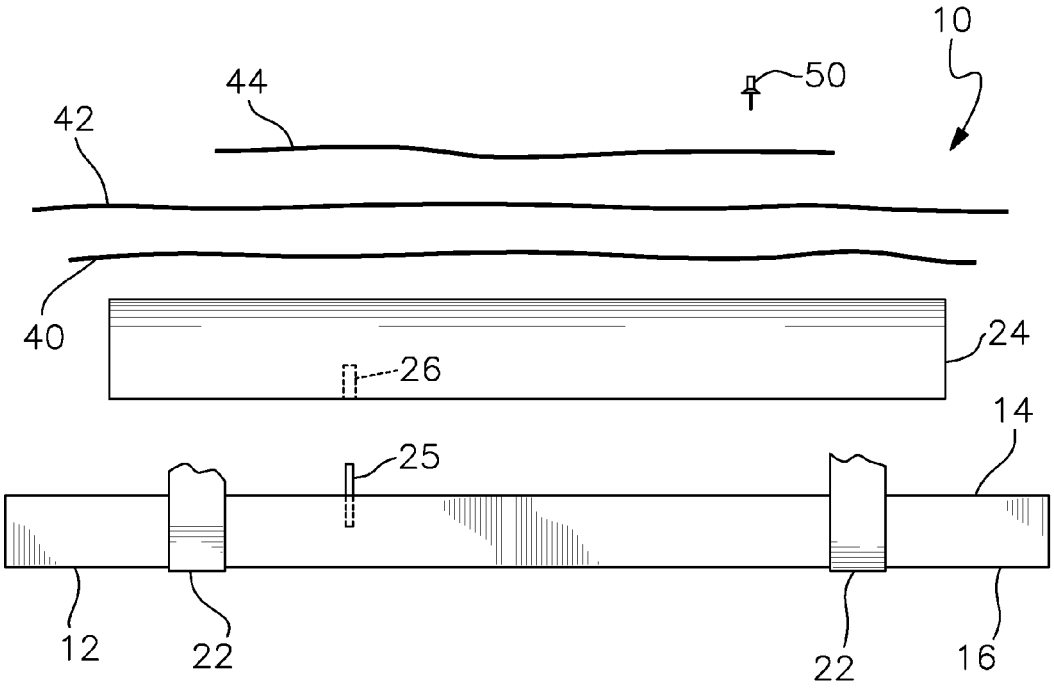
FIG. 2 is an elevational, exploded side view of the wiping board apparatus of FIG. 1.
Figure 3:
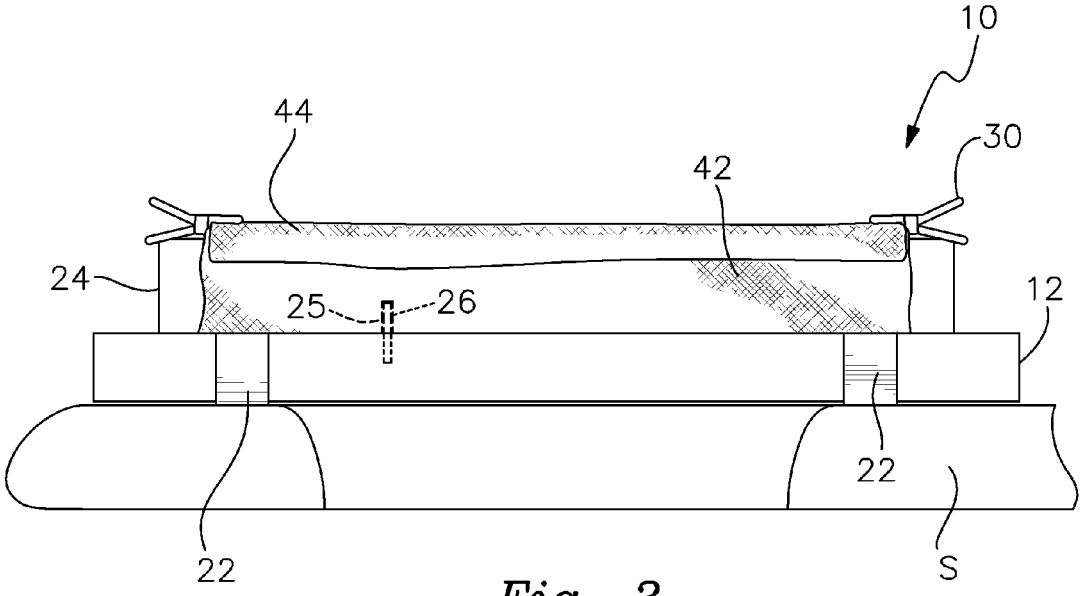
FIG. 3 is an elevational side view of the wiping board apparatus of FIGS. 1 and 2 in an assembled condition.

There is shown in FIGS. 1-3 a wiping board apparatus 10 that is used to clean fecal material from a person's rectal area following defecation. Apparatus 10 is designed primarily for use in combination with a toilet T and, more particularly, is intended to be mounted on top of toilet seat S. However, it should be understood that apparatus 10 may be supported on other portable and stationary seat surfaces and used in an analogous manner for rectal cleaning in accordance with this invention.

Apparatus 10 includes a base 12, which comprises a relatively rigid board or panel having a rectangular configuration. Base 12 is preferably composed of polypropylene or an alternative medial grade plastic that is both hygienic and relatively easy to clean. The base should have a width (side to side) of about 14", a length (front to back) of approximately 10"-13" and a thickness of about ⅜". The thickness, length and width may be varied and the overall configuration of base 12 may also be altered within the scope of this invention. It is important that base 12 be of a size and shape that allow it to mount securely onto the top surface of virtually any toilet seat such as seat S in FIG. 1. Means for accomplishing such an attachment are described more fully below. The panel should be strong and durable enough to withstand prolonged and repeated use. The base must also be strong enough to support the weight of virtually any person using apparatus 10.

Base 12 includes upper and lower surfaces 14 and 16 respectively. The base may feature an integral handle that is defined by an orifice (not shown) formed in the base and extending through the base from top surface 14 to bottom surface 16. This effectively forms a handle that allows the wiping board apparatus 10 to be conveniently carried and maneuvered to mount the apparatus on top of a toilet seat. The handle is disclosed in Provisional Application Ser. No. 62/092,300 (hereinafter Application Ser. No. '300), the specification and various features of which are incorporated by reference.

A pair of resilient retaining bands 22 are wrapped laterally about and encircle base 12 such that each band 22 extends across the width of the base and along upper and lower surfaces 14 and 16. The bands may be composed of a non-skid, frictionally gripping elastic material, which allows the bands to expand as described more fully below and also to effectively grip the surface of the underlying toilet seat S so that the wiping board apparatus 10 does not slide or move excessively during use. In particular, each band comprises a circular or other closed loop or elastic band configuration. The portion of each retaining band 22 that extends across the bottom surface 16 of base 12 engages the upper surface of toilet seat S to hold the wiping board in place during use. The resilient retaining bands 22 may also be selectively disengaged from base 12 as needed. This allows the purchaser/user to attach and position the retaining bands so that they precisely interengage the particular toilet seat model with which the will be used. As shown in Application Ser. No. '300, alternative versions may employ non-skid, patch-like gripping components that are adhesively secured to the bottom of the base.

As further shown in FIGS. 1-3, an elongate rail element 24 is carried by base 12. Element 24 extends longitudinally in a generally front to back direction relative to toilet seat S. Rail element 24 is typically composed of wood, although it may also comprise a synthetic or plastic material such a polypropylene, which is both hygienic and easy to clean. Rail element 24 includes a preferred height of ⅞"-2⅜" protruding laterally upwardly from the top surface 14 of base 12. The rail element is properly positioned on the base by inserting a positioning peg or pin 25 attached to and protruding upwardly from base 12 into a positioning pilot hole 26 formed in the bottom of rail element 24. In alternative versions other numbers of positioning pins and complementary holes may be formed in the base and rail element respectively. The pins and corresponding holes may also be reversed and formed in the rail and base respectively in other versions. When multiple pairs of corresponding positioning components are used, they are arranged so that the mounted rail is aligned in the same generally front to back orientation along the base of the wiping board apparatus as shown in FIG. 1. See also Application Ser. No. '300. An optional guide line (not shown) may be formed in the base to further assist alignment and proper orientation of rail element 24. This feature is likewise depicted in application Ser. No. '300.

Wiping board apparatus 10 may come equipped with a series of rail elements 24 having a progression of heights so that the apparatus may be customized for the proposed user's size and weight. The individual rail elements 24 may be provided in ⅜" height increments ranging from ⅞"-2⅜". Different height ranges and increments may be employed within the scope of this invention. A custom rail element fit is tested and arrived at in the manner described below. When the rail element height suited for a particular user is selected, the corresponding rail is attached to the top surface 14 of base 12 by engaging the positioning hole 26 of the rail element with the positioning pin 25 of the selected rail 24. The selected rail 24 is oriented on base 12 and retaining bands 24 are stretched and wrapped across rail element 24. See FIGS. 1 and 3. The tension of the stretched band securely fastens the rail element to the top surface of the base. See FIGS. 1 and 3. It should be understood that various other forms of fasteners and adhesives may be employed to secure the rail element to the underlying base.

As further shown in FIGS. 1-3 wiping sheets 40, 42 and 44 are draped over the rail element 24 and secured to apparatus 10. In particular, the wiping sheets shown in this embodiment include a pair of microfiber cloth sheets 40 and 42 which fully cover the rail element 24. In other versions, sheets 40, 42 may fully cover the base panel 12. In some embodiments, a single microfiber sheet or even more than two such sheets may be utilized. Preferably, as depicted in FIG. 2, a strip of toilet paper 44 is applied over the microfiber cloth such that the strip of toilet paper 44 closely conforms with the underlying rail element. All three sheets (i.e. the microfiber cloth sheets and the toilet paper strip) are then secured to the underlying rail element 24. For example, these sheets are secured by clips or clamps 30 to one or both of the underlying bands 22 wrapped across rail 24. Although clips are depicted proximate both ends of the rail, they are typically required at only the rearward end closest to the toilet tank as the wiping operation is performed from back to front and the sheets are likewise pulled in that direction. Nonetheless, various numbers and arrangements of clip may be employed to hold the sheets in place. Fastening of the sheets to rail 24 and/or base 12 may also be accomplished by various other means such as the push pin connector 50 depicted in FIG. 2. Alternative types of connectors such as hooks, bands, clamps etc. may be employed to hold the wiping sheets(s) onto and covering the longitudinal rail element. For example, Velcro closable connecting bands may be used. It should also be understood that these sheets may be secured to the base instead of, or in addition to the rail element. In alternate embodiments multiple layers of toilet paper may be applied over the cloth sheets(s).

Apparatus 10 is assembled and used as follows. Typically, apparatus 10 is provided in the form of a kit to be assembled, including the base 12, a series of rails 24 having various heights, and an optional supply of microfiber cloth sheets 40, 42. A plurality of retaining bands 22 may also be included in the kit. The base is first placed upon the toilet to ascertain the correct positioning for the gripping components (bands) on the base relative to that user's particular toilet. The retaining bands are wrapped about and properly positioned on base 12 and the base is then positioned on the toilet seat such that the segments of bands 22 extending across bottom surface 16 of base 12 provide a slide resistant grip between board 10 and toilet seat S.

Next, the intended user tests the series of rail elements to determine the custom rail element that best fits that user. Typically, the user will place successive sizes of the trial elements 24 on the top surface of base 12. Each rail element will be covered by two layers of microfiber cloth sheets 40, 42. The proposed user will then test each successive rail element size for comfort by sitting on the base and straddling the rail element. A rail element that is slightly uncomfortable for the user will typically perform the wiping function most effectively. This rail element should be selected for the person's use Employing a rail element taller than the selected element may risk injury to the user's coccyx or tail bone. Using a shorter rail element than the one selected may result in ineffective wiping and cleaning. Nonetheless, over time, a particular user may gradually become more acclimated to a particular rail element height and may be able to safely increase the height of the marking bar slightly to achieve greater pressure and more effective wiping and cleaning.

After the appropriately sized rail element is selected positioned and attached, preparation of the apparatus is completed by draping one or two sheets of microfiber cloth 40, 42 over the rail element such that it is completely covered. One or more multiple strips of toilet paper 44 may also be engaged over the microfiber sheet(s) and all sheets may be attached to bands 22 (and at least to the rearward retaining band) and thereby to base 12 and rail 24 by clips 30. Velcro strips and other means of fastening the wiping sheets to cover the rail element may also be used.

Following defecation, assembled apparatus 10 is positioned on and interengaged with the top surface of toilet seat S as shown in FIG. 1. The user then sits on the toilet and, more particularly, on base 12 of apparatus 10 such that the user straddles the installed rail element and wiping sheets that cover the rail element. The user slides forwardly along the underlying base and over the rail element in a motion that mimics traditional front-to-back hand wiping such that fecal material is wiped by the microfiber and toilet paper sheets and the rectal area is cleaned. The user's weight applies pressure against the underlying rail element and wiping sheets. Typically, the user has to slide only a few inches until he or she slides off of the front end of the rail element. Cleaning is thereby performed quickly and effectively by employing a properly sized (i.e. slightly uncomfortable) rail element. The sliding operation may be repeated as needed and toilet paper and/or microfiber sheets may be replaced as required. Following the wiping operation, the sheets are removed and flushed, discarded or washed as appropriate. The entire apparatus itself is also cleaned relatively quickly and conveniently.

Figure 4:
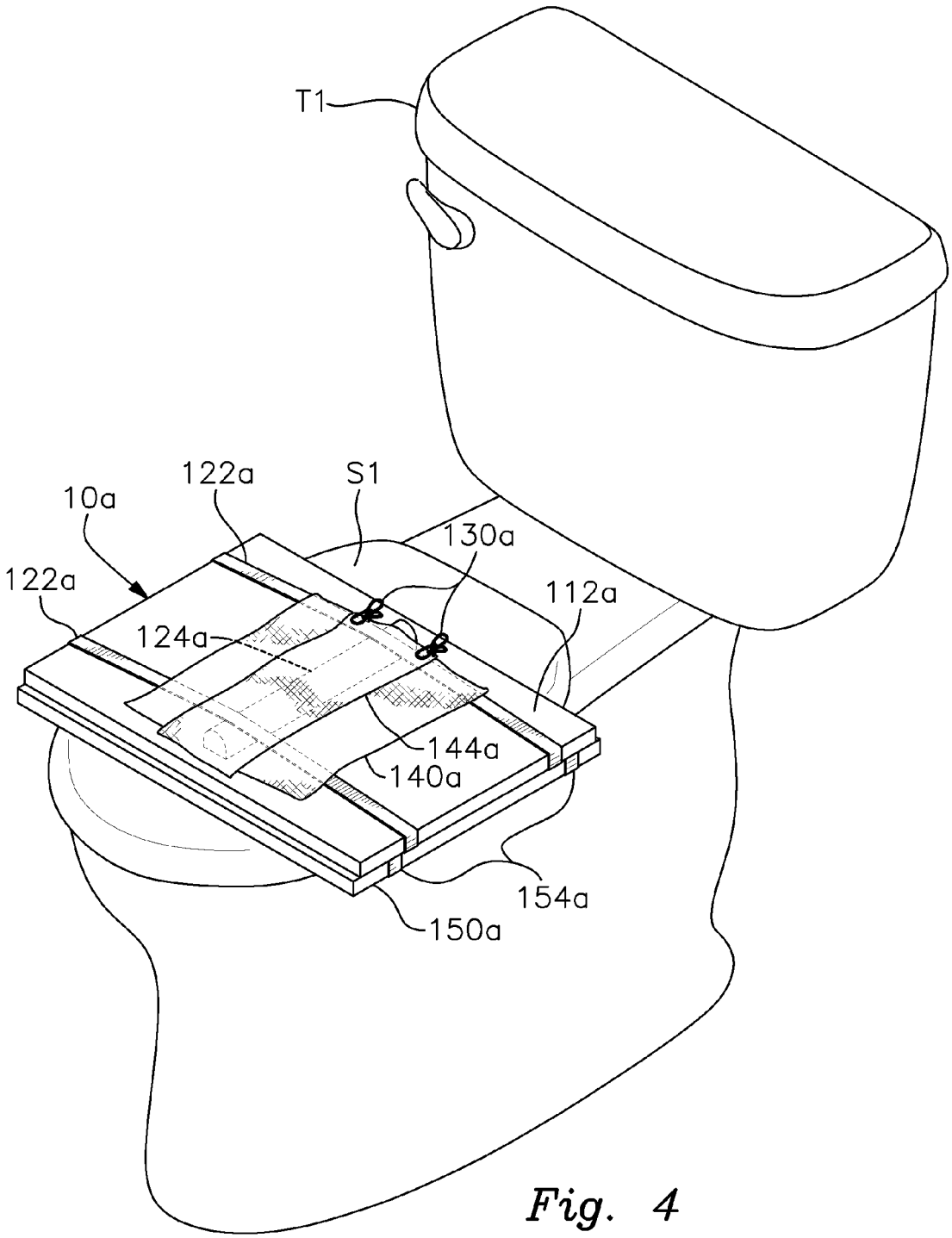
FIG. 4 is a perspective view of an alternative preferred version of this invention employing an adapter board that is mounted on the existing toilet seat to modify and significantly reduce the size of the opening in the toilet seat through which the user defecates in order to facilitate defecation and post defecation cleaning of the user's rectal area.
Figure 5:
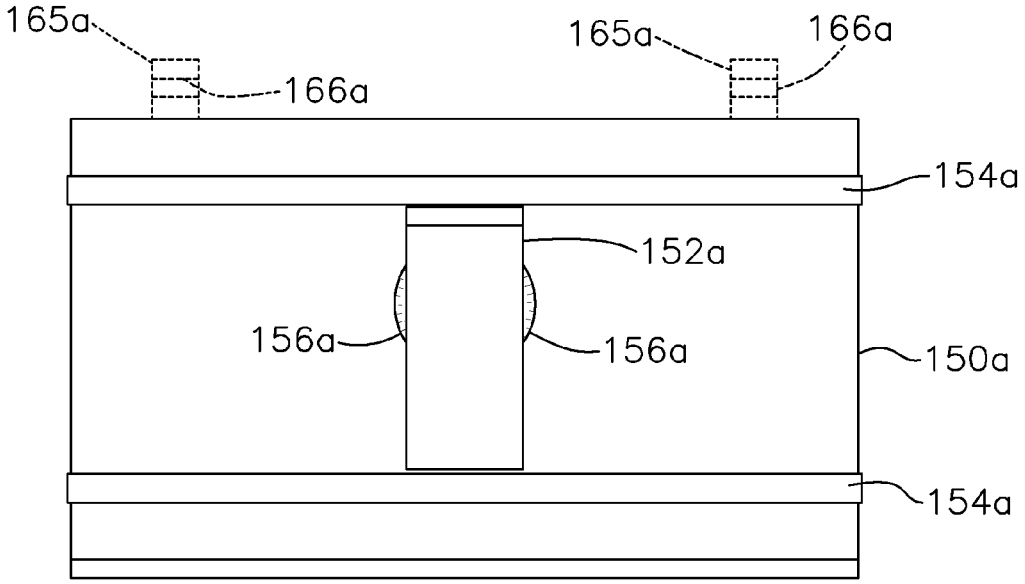
FIG. 5 is an upper front perspective view of the adapter piece utilized in the version of FIG. 4 and further depicting optional hinge bushings that allow the adapter piece to be hingedly mounted directly to the toilet bowl so that the adapter piece serves as the toilet seat.

FIGS. 4-7 depict an alternative version of this invention wherein the wiping board apparatus 10*a*, shown assembled and installed on a toilet T1 in FIG. 4, employs a toilet seat adapter piece 150*a*, which is shown alone in FIG. 5. More particularly, the toilet seat adapter piece is designed to provide improved user support, particularly for obese or overweight persons. Traditionally, many if not most toilet seats employ openings that are approximately 8-9" wide. Such a diameter causes the user's weight to be largely supported by the femur bones of the user's legs rather than the ischial tuberosities at the lower end of the skeletal torso and in proximity to the user's rectal area. Although this positioning is typically acceptable for average sized persons, it can create a real problem for obese and overweight persons. Such individuals typically have bodily fatty tissue that is compressed between the supportive femurs and the toilet seat. This can significantly compress the rectal passageway, which can in turn cause problems as described above. Cleaning following defecation can be a particularly annoying, unpleasant and time consuming.

The use of adapter piece 150*a* addresses and overcomes the foregoing problem. In particular, the adapter piece serves effectively as the toilet seat when the base and attached rail of the wiping board are disengaged from the adapter component.

As shown in FIG. 5, adapter piece 150*a* comprises a rectangular board or panel which again may be composed of polycarbonate or similar material. The board has a side to side width (when mounted on a toilet seat) of 13" and a length (front to back relative to the toilet seat) of 14". Alternative dimensions may be used within the scope of this invention. Piece 150*a* has a defecation slot 152*a* that is formed fully through piece 150*a* from the top surface to the bottom surface of the board. Slot 152*a* extends in a front to rear direction and is disposed centrally within the adapter board. The slot has dimensions of approximately 4" in width by 10" in length. The adapter board has a thickness of approximately ⅜". These dimensions may be varied within the scope of this invention.

A pair of elastic retaining bands 154*a* are wrapped about adapter piece 150*a*. Each band extends from side to side and comprises a circular or other closed loop band composed of a non-skid frictionally gripping material.

Figure 6:
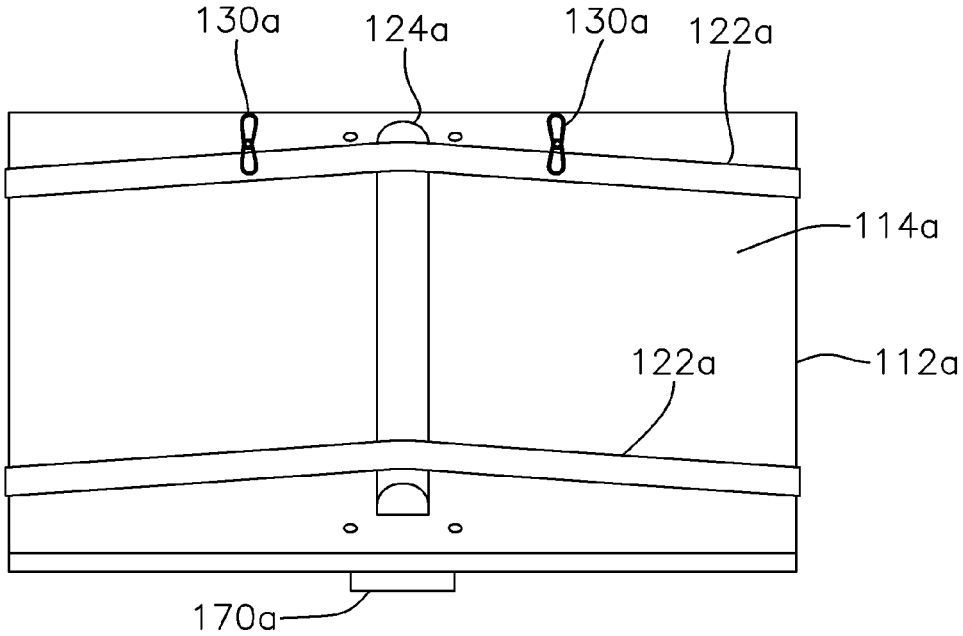
FIG. 6 is an upper front perspective view of a base and attached rail element which are releasably engageable with the adapter piece.
Figure 7:
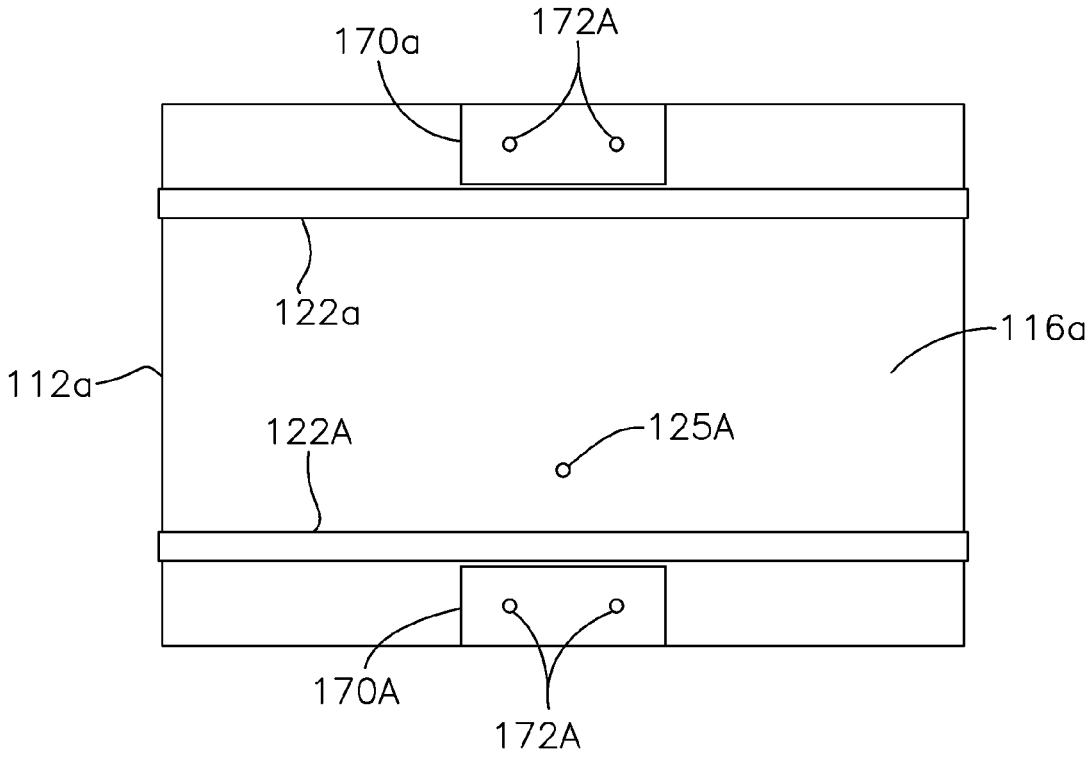
FIG. 7 is a bottom view of the base utilized in the version of FIGS. 4-6.

A base 112*a* designed to operate in conjunction with adapter component 150*a* is depicted in FIGS. 4, 6 and 7. Base 112*a* is constructed analogously to base 112 described in the previous embodiment. In particular, the base includes a rectangular panel having a side to side width that generally conforms to that of the adapter component and a front to back length that is slightly (2-3") shorter than that of the adapter component.

As in the prior embodiment, a rail element 124*a* is positioned upon and secured to an upper surface 114*a* of base 112*a*. A positioning pin or peg as described in the prior embodiment, may be likewise employed in this version. In addition, a pair of elastic retaining bands 122*a* are again wrapped laterally about and encircle base 112*a*. The bands pass over rail 124*a* and feature sufficient elastic tension to hold the rail element securely in place against the upper surface 114 of base 112 such that the rail element protrudes upwardly from the upper surface of the base element in a manner similar to that previously described.

As shown in FIG. 7, bottom surface 116*a* of base 112*a* carries a positioning guide assembly comprising forward and rearward guide blocks 170*a*. These guide blocks are composed of material identical or similar to that composing the base 112*a*. The guide blocks are secured by screws 172*a* or other forms of attachment to the bottom surface 116*a* of base 112*a*. FIG. 7 also illustrates the lower end of the rail element positioning pin 125*a* mounted to base 112*a* and extending upwardly from the opposite upper surface thereof. In addition, the lower sections of retaining bands 122*a* extending across bottom surface 116*a* of base 112*a* are shown.

Base 112*a* and adapter piece 150*a* are assembled to form wiping board apparatus 10*a* as shown in FIG. 4. In particular, the bottom surface 116*a* of base 112*a* is engaged with the upper surface of adapter piece 150*a* such that guide blocks 170*a*, FIGS. 6 and 7 of base 112*a* are inserted into slot 152*a* of adapter piece 150*a*. The respective blocks 170*a* are configured and sized to conform with the shapes of the leading and trailing ends respectively of slot 152*a*. This holds the base 112*a* securely and relatively immovably against the underlying adapter piece 150*a*. More particularly, the base board is restricted from moving either forwardly, rearwardly or laterally relative to adapter piece 150*a* during use of apparatus 10*a*. When the components are interengaged in this manner, they may be mounted on the toilet seat S1 as shown in FIG. 4 and utilized as will be described below.

Alternatively, wiping board apparatus 10*a* may be disassembled by disengaging base 112*a* from underlying adapter piece 150*a*. This is accomplished by simply separating the base from the adapter piece and lifting guide blocks 170 out of slot 152*a*. See FIGS. 5 and 6 where the respective pieces are shown separately and in a disengaged condition.

In the disengaged condition, adapter piece 150 may be used effectively and conveniently with conventional toilet seats to serve as a modified toilet seat with a reduced size opening. In particular, adapter piece 150*a* is placed across the upper surface of toilet seat S1. When adapter board 150*a* is placed on the toilet, the bands 154*a* wrapped about the adapter piece effectively grip the underlying toilet seat surface and prevent undue and undesired movement of the toilet seat adapter piece as the toilet is being used. The adapter piece is large enough to cover virtually all conventional toilet seat openings. At the same time, the effective opening of the toilet seat is reduced from the standard size of 8-9" to only 4" (the width of slot 152*a*), which is adequate for use by most persons. At the same time, this greatly increases the effective weight supporting seat area of the toilet. The weight of the user is now borne largely by the ischial tuberosities and not the heads of the user's femurs. In the case of overweight or obese persons, excess tissue is not unduly compressed inwardly. Defecation is therefore much less messy and subsequent wiping is facilitated.

When defecation is completed, the user may then complete the wiping and cleaning process by operably engaging base 112*a* with the underlying adapter piece 150*a* which is left mounted on the toilet. The base piece is engaged by simply inserting guide blocks 170*a* into slot 152*a*. As in the previously described embodiment, one or more microfiber cloth sheets 140*a* and strips of toilet paper 144*a* are draped over the elongate rail element 124*a*. The strips are secured in place again by clamps or clips 130*a*. Specifically, the clips secure sheets 140*a* and 144*a* to at least one of the bands (i.e. the rearward retaining band 122*a*) as shown in FIG. 4. With the wiping apparatus assembled and in position as shown in FIG. 4, the user straddles the wiping board apparatus and slides his or her rectal area a few inches along rail element 124*a* in a front to rear direction so that wiping is effectively performed. The rail element applies consistent cleaning pressure to the user's rectal area to perform quick and effective wiping.

Not only does the version of FIGS. 4-7 provide significant advantages for overweight and obese individuals, it also features a toilet seat adapter piece that is portable and convenient for the user to employ effectively as a toilet seat in restrooms and other locations away from home where the user may wish to avoid direct contact with the toilet seat.

In alternative versions, toilet seat adapter piece 150*a* may serve as a replacement for the standard or existing toilet seat. In particular, as shown in FIG. 5 a pair of hinge bushings 165*a*, shown in phantom, may be integrally attached to the rearward edge of adapter piece 150*a* or elsewhere along the adapter piece for securing directly to the hinge components conventionally carried by virtually all toilet bowls. For example, the standard hinge pins (not shown) used by virtually all toilet bowls may be interengaged with the conventional hinge yokes employed by the toilet bowl and thereby hingedly interengaged with the openings 166*a* formed through bushings 165*a* of adapter piece 150*a*. This allows the adapter piece 150*a* to function as the toilet seat for the toilet. This replacement toilet seat provides a much greater weight supportive surface area and, at the same time, employs a 4" wide slot 152*a* that is wide enough for most defecation purposes. The larger supportive surface provided by adapter piece 150 provides most users with a much more comfortable toilet seat that, in most cases, supports the user's weight through the user's ischial tuberosities bones. The adapter piece may have various sizes, shapes and thicknesses and the defecation slot 152 may be alternatively configured in size within the scope of this invention.

In still other embodiments, the rail may be resiliently attached to the base and protrude through a channel or slot in the base. This allows the rail to be height adjustable to accommodate various sizes of persons using the apparatus. See Application Ser. No. '300.

A pair of fairly shallow user positioning indicators comprising depressions or recesses 156*a* may be formed along respective longitudinal side edges of slot 152*a*. Each recess generally extends from about the mid-length position of the typically 10" defecation slot rearwardly for about a couple of inches. User positioning recesses 156*a* allow the user to quickly and comfortably adjust his or her position on board 150*a* when the user is seated on the board as installed on the toilet. The portion of each ischial tuberocity bone of the user that comes into contact with the upper surface of board 150*a* is approximately 2" long front to back. Accordingly, user positioning recesses 156*a* comfortably accommodate the user's ischial tuberocity bones and enable the user to readily determine a suitable sitting position straddling defecation receptacle 152*a* on toilet adapter piece 150*a*. In alternative embodiments, the positioning indicators may comprise grooves, notches, ridges or other tactile features formed in the upper surface and/or along the longitudinal edges of the defecation slot of adapter board 15*a*, which permit the user to readily determine a proper sitting position on the adapter piece.

The present invention enables persons to quickly and conveniently perform wiping without the messiness, potential germ transmission, adverse environmental impact and cost disadvantages associated with conventional toilet paper wiping. Far less toilet paper is required than is needed for conventional toilet paper and much less of that product is wasted. Although these benefits accrue from use of the invention by virtually anyone, the wiping board apparatus provides particular help to persons who encounter difficultly performing traditional hand wiping such as persons with disabilities, the elderly and small children. The invention allows hygienic wiping to be performed in a convenient and fairly comfortable hands free manner and without requiring physical maneuvers such as turning, bending, and reaching which may be difficult or painful for persons with physical limitations to perform.

Accordingly, the present invention relates to an improved, highly efficient wiping board apparatus for cleaning a person's rectal area following defecation. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. A wiping board apparatus for use in combination with a toilet seat for cleaning a user's rectal area following defecation, said apparatus comprising:

a base for mounting on the toilet seat;

an elongate rail element attached to an upper surface of said base and extending longitudinally along said base in a generally front to back orientation relative to the toilet seat, said elongate rail element protruding upwardly from said upper surface of said base; and at least one flexible wiping sheet releasably secured to at least one of said base and said elongate rail element such that said at least one flexible wiping sheet covers said elongate rail element;

wherein the at least one flexible wiping sheet includes a flexible fabric material and at least one layer of toilet paper attached above said flexible fabric material;

whereby following the user's defecation, said base is mounted on the toilet seat with said elongate rail element facing upwardly and extending generally front to back on the toilet seat and the at least one flexible wiping sheet is connected to at least one of the base and the elongate rail element; the user sits upon the base, straddles the sheet covered elongate rail element and slides forwardly along the elongate rail element such that the at least one flexible wiping sheet wipes and cleans the rectal area of the user.

2. The apparatus of claim 1 in which said base includes a generally flat board.

3. The apparatus of claim 2 in which one of said board and said elongate rail element carries one or more positioning pins, each positioning pin engaging a corresponding positioning hole formed in the other of said board and said elongate rail element to position said elongate rail element on said base.

4. The apparatus of claim 1 in which said elongate rail element is secured to said upper surface of said base by at least one elastic band wrapped about and encircling said base and said elongate rail element attached to said base.

5. The apparatus of claim 4 in which the at least one flexible wiping sheet is releasably attached to the at least one elastic band holding the elongate rail element in position on the base.

6. The apparatus of claim 1 further including a toilet seat adapter piece for mounting on the toilet seat and disengagably supporting said base, said toilet seat adapter piece having an elongate defecation slot alignable with an opening through the toilet seat, said elongate defecation slot being exposed when said base is disengaged from said toilet seat adapter piece to allow the user to sit on said toilet seat adapter piece and defecate through said elongate defecation slot.

7. The apparatus of claim 6 in which said base carries a guide assembly received by said elongate defecation slot for restricting movement between said base and said toilet seat adapter piece when base is engaged with said toilet seat adapter piece and during use of said wiping board apparatus to clean the user's rectal area.

8. The apparatus of claim 7 in which said guide assembly includes a pair of guide blocks that respectively abut forward and rearward edges of said elongate defecation slot when said base is engaged with said toilet seat adapter piece.

9. The apparatus of claim 6 in which said toilet seat adapter piece carries at least one skid resistant band for interengaging the toilet seat to which said toilet seat adapter piece is mounted.

10. The apparatus of claim 6 in which said toilet seat adapter piece includes a generally planar board.

11. A wiping board apparatus for use in combination with a toilet having a toilet bowl, said apparatus for cleaning a user's rectal area following defecation, said apparatus comprising:

a toilet seat adapter piece for mounting on the toilet bowl and having an elongate defecation slot alignable with an interior of the toilet bowl;

a base for removably mounting on said toilet seat adapter piece;

an elongate rail element attached to an upper surface of said base and extending longitudinally along said base in a generally front to back orientation relative to the seat surface toilet seat adapter piece, said elongate rail element protruding upwardly from said upper surface of said base; and at least one flexible wiping sheet releasably secured to at least one of said base and said elongate rail element such that said at least one flexible wiping sheet covers said elongate rail element;

whereby following a user's defecation, said base is mounted on the toilet seat adapter piece with said elongate rail element facing upwardly and extending generally front to back on the toilet seat adapter piece and the at least one flexible wiping sheet is connected to at least one of the base and the elongate rail element and the user sits upon the base, straddles the sheet covered elongate rail element and slides forwardly along the elongate rail element such that the at least one flexible wiping sheet wipes and cleans the rectal area of the user;

said elongate defecation slot of said toilet seat adapter piece being exposed when said base is disengaged from said toilet seat adapter piece to allow the user to sit on said toilet seat adapter piece and defecate through said elongate defecation slot.

12. The apparatus of claim 11 in which said base carries a guide assembly received by said elongate defecation slot for restricting movement between said base and said toilet seat adapter piece when said base is engaged with said toilet seat adapter piece and during use of said wiping board apparatus to clean the user's rectal area.

13. The apparatus of claim 12 in which said guide assembly includes a pair of guide blocks that respectively abut forward and rearward edges of said elongate defecation slot when said base is engaged with said toilet seat adapter piece.

14. The apparatus of claim 11 in which said toilet seat adapter piece is hingedly connected to the toilet bowl, said elongate defecation slot extending front to back relative to the toilet bowl and being no greater than about four inches in width.

15. The apparatus of claim 11 in which said toilet seat adapter piece includes a generally planar board that is releasably attachable to the toilet bowl for replacing a toilet seat.

16. The apparatus of claim 11 in which said toilet seat adapter piece includes a tactile user positioning groove formed along a longitudinal edge of said elongated defecation slot for enabling positioning of the user on the toilet seat adapter piece.

* * * * *